United States Patent [19]

Lozaun

[11] Patent Number: 4,477,015

[45] Date of Patent: Oct. 16, 1984

[54] TWO-PIECE, SELF-LOCKING CONTAINER

[75] Inventor: Gary D. Lozaun, Whittier, Calif.

[73] Assignee: Container Corporation of America, Chicago, Ill.

[21] Appl. No.: 496,051

[22] Filed: May 19, 1983

[51] Int. Cl.[3] ..... B65D 5/32; B65D 5/36

[52] U.S. Cl. ..... 229/23 R; 229/41 R; 229/44 R

[58] Field of Search ..... 229/23 R, 23 BT, 23 A, 229/44 R, 41 R, 41 B, 16 R; 206/45.3

[56] References Cited

U.S. PATENT DOCUMENTS

| | | | |
|---|---|---|---|
| 655,939 | 8/1900 | Overton | 229/23 R |
| 674,009 | 5/1901 | Lewis | 229/23 R |
| 690,575 | 1/1902 | Herre | 229/44 R |
| 858,278 | 6/1907 | Gilman | 229/41 R |
| 930,114 | 8/1909 | Adams | 229/23 R |
| 1,859,903 | 5/1932 | Wellman | 206/45.3 X |
| 2,003,224 | 5/1935 | Schoettle | 229/44 R |
| 2,221,368 | 11/1940 | Buser | 229/41 B X |
| 2,538,860 | 1/1951 | Buttery | 229/41 B |
| 2,938,623 | 5/1960 | Eichorn | 229/23 R |
| 3,918,576 | 11/1975 | Taub | 229/23 BT X |

FOREIGN PATENT DOCUMENTS

| | | | |
|---|---|---|---|
| 188889 | 4/1964 | Sweden | 229/44 R |
| 20144 | of 1892 | United Kingdom | 229/23 R |

*Primary Examiner*—William Price
*Assistant Examiner*—Gary E. Elkins
*Attorney, Agent, or Firm*—Richard W. Carpenter

[57] ABSTRACT

A collapsible two-piece self-locking container formed of paperboard and including a body member with a lock-bottom construction and a cover member having interlocking engagement with the body member and including panels reinforcing the bottom and rear walls of the body member.

1 Claim, 7 Drawing Figures

TWO-PIECE, SELF-LOCKING CONTAINER

BACKGROUND OF THE INVENTION

1. Field of the Invention

This invention relates generally to containers and more particularly to a collapsible, two-piece, self-locking container formed of paperboard and including a body member with a lock bottom construction and a cover member having interlocking engagement with the body member and including panels reinforcing both the bottom and rear walls of the body member.

2. Description of the Prior Art

A prior art search in the United States Patent and Trademark Office directed to the subject matter of this application disclosed the following U.S. Pat. Nos. 674,009; 881,567; 930,114; 1,147,551; 1,647,820; 1,678,538; 1,945,251; 1,951,249; 1,976,973; 2,271,244; 2,319,919; 2,597,846; 2,938,623; 4,148,427.

None of the prior art patents uncovered in the search discloses a collapsible container having separate body and cover members interlockingly joined to each other wherein the cover member not only includes a lid for the body member but also includes panels for reinforcing the rear wall and the bottom wall of the body member of the container.

SUMMARY OF THE INVENTION

An object of the invention is to provide a collapsible, two-piece, self-locking paperboard container having separate body and cover members interlockingly joined to each other.

Another object of the invention is the provision, in a container of the type described, of a bottom wall arrangement including a lock bottom reinforced by a full panel.

A more specific object of the invention is the provision, in a container of the type described, of a cover member including a lid and panels adapted to engage the inner surfaces of and reinforce the container body member rear and bottom walls.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 3:
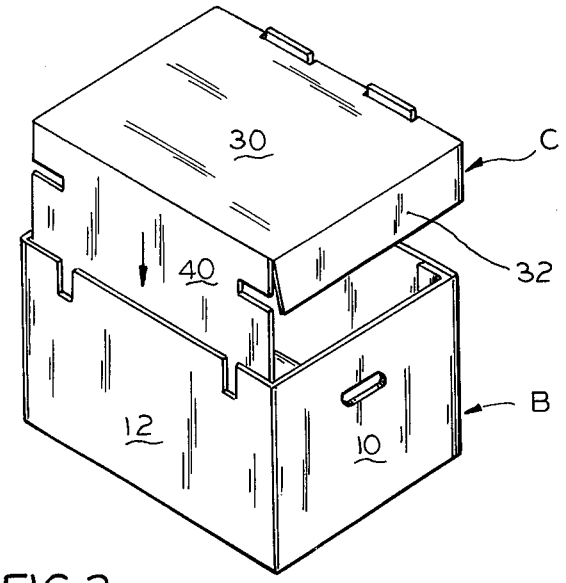
FIG. 3 is an exploded perspective view, as seen from the rear, illustrating the manner in which the two members of the container are used to form the assembled container.
Figure 2:
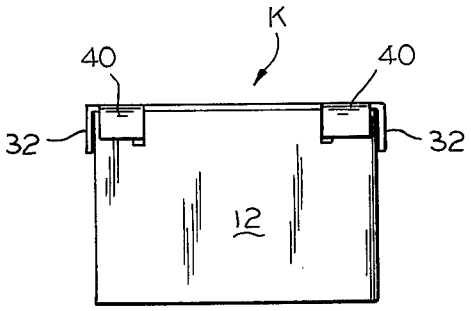
FIG. 2 is a rear elevational view of the structure illustrated in FIG. 1, but the cover shown in a closed position.
Figure 1:
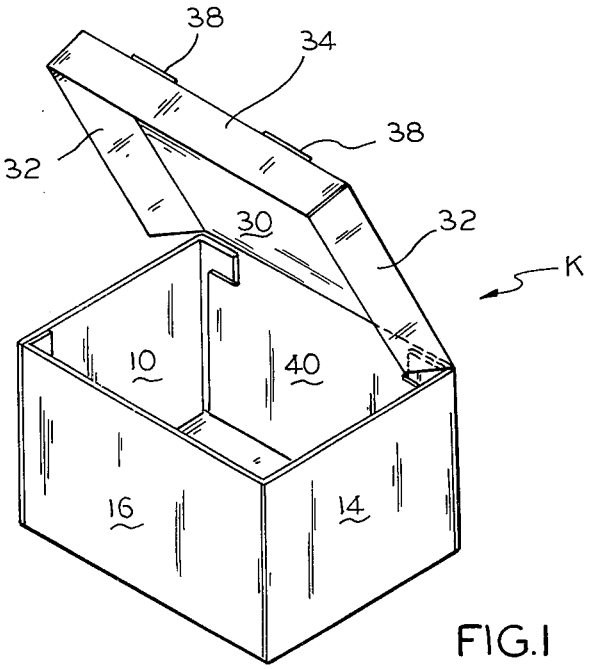
FIG. 1 is a perspective view of an assembled container embodying features of the invention, as seen with the cover in an open position.
Figure 5:
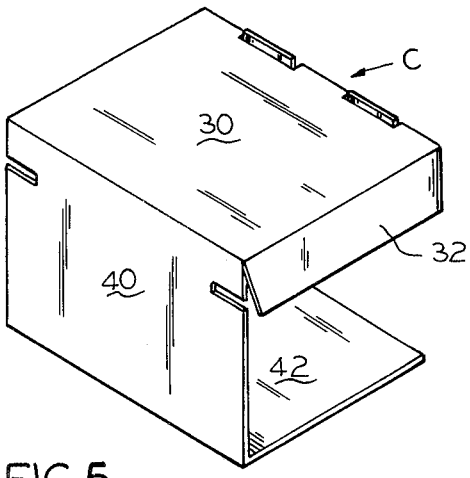
FIGS. 4 and 5 are perspective views, as seen from the rear, of the body and cover members of the container illustrated in the earlier views.
Figure 4:
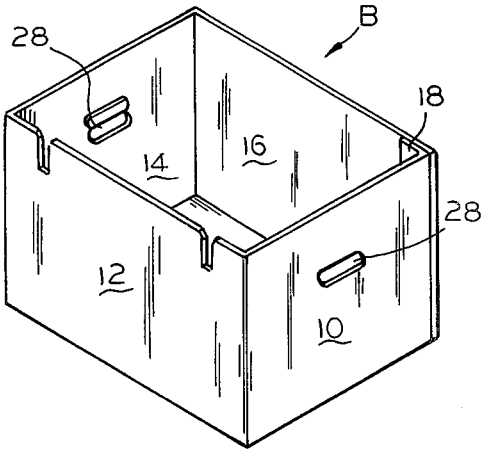

Referring now to the drawings for a better understanding of the invention, it will be seen that the novel container indicated generally at K in FIGS. 1–3 is formed from a pair of components illustrated in FIGS. 4 and 5. The components include the body member indicated generally at B in FIG. 4 and the cover member indicated generally at C in FIG. 5.

These components are placed together in interlocking position in a manner hereinafter described to provide a container of the type which may be used for the storage of files, records, or other items and which may be manually set up without requiring any additional securing means. The novel construction of the container affords a reinforced rear wall and bottom wall to give extra strength for supporting the contents of the container.

Figure 6:
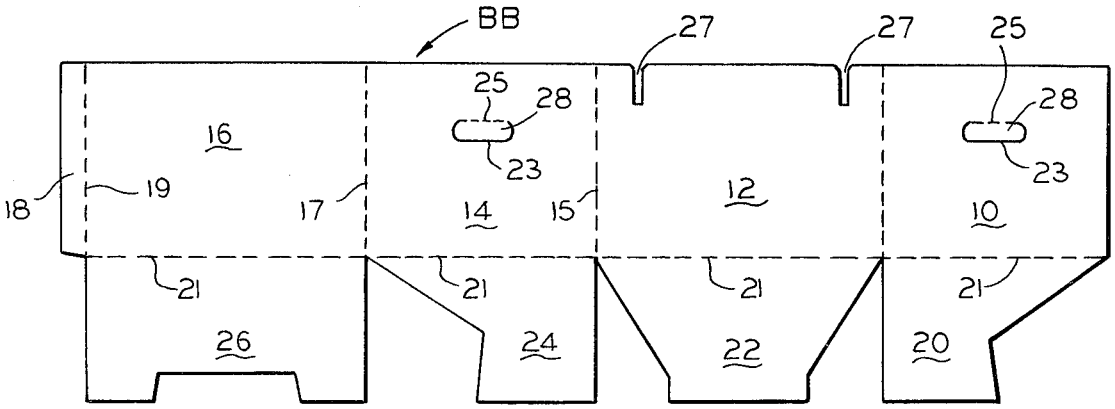
FIGS. 6 and 7 are plan views of blanks of foldable sheet material from which the container components illustrated in FIGS. 4 and 5, respectively, may be formed.

As best seen in FIGS. 4 and 6, the body member B of the container is formed from the blank BB of sheet material such as paperboard and includes a first end wall 10, a rear wall 12, a second end wall 14, a front wall 16, and a glue flap 18, all of which are foldably joined to each along parallel fold lines 13, 15, 17, and 19, respectively. Foldably joined to the lower edges of panels 10, 12, 14, and 16 along a common fold line 21 are lower closure panels 20, 22, 24, and 26, respectively, which are of the conventional type to provide a lock bottom construction which does not require any additional gluing, stapling, or taping to hold the body in erected condition.

Still referring to FIG. 6, it will be seen that rear wall 12 is provided adjacent its upper edges with a pair of spaced vertically extending slots 27, the purpose of which is described later in the specification.

Figure 7:
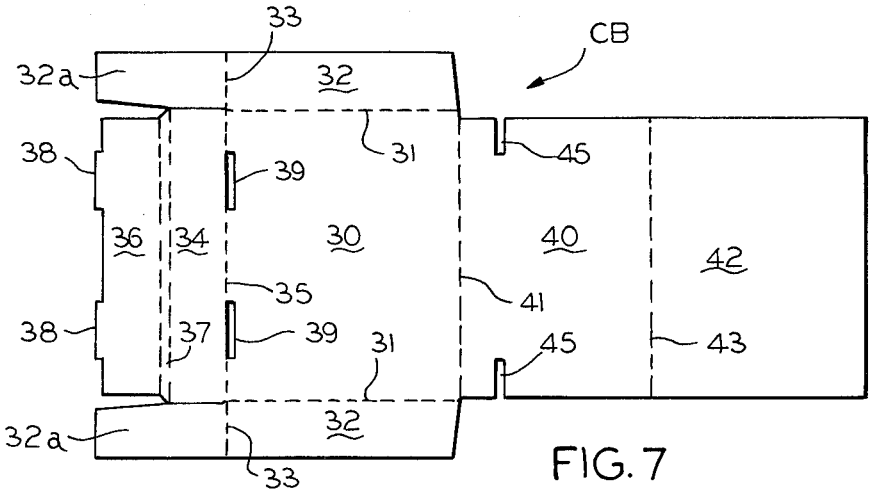

Now turning to FIGS. 5 and 7 of the drawings, it will be seen that the cover member C illustrated in FIG. 5 may be formed from the blank CB of foldably sheet material illustrated in FIG. 7.

Cover member C includes a top panel 30 having a pair of side flanges 32 foldably joined along fold lines 31 to opposite side edges thereof and a front outer flange 35 foldably joined to its forward edge along fold line 34. Flange outer panel 34 has in turn foldably joined to its lower edge on fold line 37 an inner flange panel 36 which is folded a 180° so as to lie in face-to-face with the rear surface of panel 34. Panel 38 may be provided at its upper edge with a pair of lock tabs 36 which are adapted to extend through related apertures 39 in top panel 30 to provide a "Walker-lock" type connection.

A rear panel 40 is foldably joined along a fold line 41 to the rear edge of top panel 30 and has in turn foldably joined to its lower edge along fold line 43 a bottom panel 42.

It will be noted that rear panel 40 is provided with a pair of laterally extending slots 45 which are located adjacent opposite side edges thereof for use in providing an interlocking connection between the cover member and the body member as hereinafter described.

In assembling the container from the two components previously described, as best seen in FIG. 3, the cover member is inserted into the body member with the cover member bottom panel 42 lying on top of the body member bottom closure flaps to reinforce the bottom wall of the container.

At the same time the rear panel 40 of the cover member is disposed against the inner surface of the body member rear wall 12, with the slots 45 of the cover member rear panel engaging the slots 27 of the body member rear wall, to provide an interlocking connection between the two components and reinforce the body members rear wall.

Thus, when assembled the container body is reinforced and is provided with a hinged cover having flanges which cover the upper portions of the body member when the cover member is in the closed condition.

What is claimed is:

1. A collapsible, two-piece, self-locking container formed of foldable sheet material, such as paperboard, comprising:

(a) a body member including opposed pairs of front and rear side walls and end walls foldably joined to each other and having foldably joined to their lower edges bottom closure flaps disposed in partially overlapping, interlocking engagement with each other to form a bottom wall having a lock bottom construction;

(b) a separate cover member including:

(i) an inner rear wall panel of substantially the same dimensions as and disposed against the inner surface of said body member rear wall and having interlocking engagement therewith to reinforce said rear wall and increase stacking strength of said container;

(ii) an inner bottom wall panel foldably joined to said rear wall panel and of substantially the same dimensions as and disposed against the inner surface of said body member bottom wall to reinforce said bottom wall;

(iii) a top wall panel foldably joined to said rear wall panel and having front and side flanges depending therefrom to provide a hinged cover for said body member;

(c) said cover member rear wall panel presenting a pair of slots located adjacent the upper edge thereof and extending laterally inward therefrom for interlocking engagement with a related pair of slots extending downwardly from the upper edge of said body member rear wall.

* * * * *